US007650847B1

(12) United States Patent
Wicks et al.

(10) Patent No.: US 7,650,847 B1
(45) Date of Patent: Jan. 26, 2010

(54) WATERCRAFT STABILIZATION SYSTEM

(76) Inventors: Aaron D. Wicks, 9001 Millinockett La., Winter Park, FL (US) 32825; Frederic Wicks, 1705 Brazilian La., Winter Park, FL (US) 32792

( * ) Notice: Subject to any disclaimer, the term of this patent is extended or adjusted under 35 U.S.C. 154(b) by 0 days.

(21) Appl. No.: 12/221,472

(22) Filed: Aug. 4, 2008

(51) Int. Cl.

| | |
|---|---|
| ***B63B 39/00*** | (2006.01) |
| ***B63B 43/14*** | (2006.01) |
| ***B63B 17/00*** | (2006.01) |
| *B63B 35/71* | (2006.01) |

(52) U.S. Cl. ..... 114/123; 114/343; 114/347; 114/364

(58) Field of Classification Search ... 114/61.15–61.19, 114/68, 121, 123, 283, 292, 343, 347, 360, 114/362, 364

See application file for complete search history.

(56) References Cited

U.S. PATENT DOCUMENTS

| | | | | |
|---|---|---|---|---|
| 655,234 | A * | 8/1900 | Howe et al. | 114/123 |
| 2,596,194 | A * | 5/1952 | Anderson | 114/123 |
| 2,794,191 | A * | 6/1957 | Gaskouitz | 114/123 |
| 3,276,413 | A * | 10/1966 | Dolph et al. | 114/123 |
| 4,641,594 | A | 2/1987 | Birkett | |
| 5,174,233 | A | 12/1992 | Nielsen | |
| 5,636,585 | A * | 6/1997 | Schulz | 114/123 |
| 5,673,642 | A * | 10/1997 | Headge | 114/123 |
| 5,988,090 | A | 11/1999 | Barker, Jr. | |
| 6,000,355 | A | 12/1999 | Hall | |
| 6,050,210 | A * | 4/2000 | Grzybowski | 114/123 |
| 6,305,306 | B1 | 10/2001 | Grzybowski | |
| 6,860,216 | B1 | 3/2005 | Morriseau | |

* cited by examiner

*Primary Examiner*—Ajay Vasudeva
(74) *Attorney, Agent, or Firm*—William M. Hobby, III

(57) ABSTRACT

This invention relates generally to the stabilization of watercraft, such as kayaks and canoes, and especially to the stabilization of a kayak to allow an individual to stand or move in a kayak without the kayak rocking or rolling over. The pontoon assembly is mounted to a kayak which allows for extending a stabilizing pontoon individually on each side of the watercraft and locking the pontoon at an operative position. Each pontoon can be rapidly raised to a rest position for paddling the kayak or canoe.

15 Claims, 5 Drawing Sheets

WATERCRAFT STABILIZATION SYSTEM

BACKGROUND OF THE INVENTION

This invention relates generally to the stabilization of watercraft, such as kayaks and canoes, and especially to the stabilization of a kayak or canoe to allow an individual to stand or move therein without the kayak or canoe rocking or rolling over. More particularly, the invention relates to a pontoon assembly which is in a raised rest position for paddling but which can be rapidly extended alongside the kayak or canoe to provide stabilization.

Floats and pontoons for stabilizing watercraft which are positioned alongside of the watercraft are old and well known in the art. Devices are presently available to address stabilization through the addition of floatation devices. In more recent times these devices have been provided with clamping supports and allow floatation to be clamped to a canoe and are generally held on a fixed extended position from the side of the watercraft. These devices are used to prevent sudden overbalance movement by an occupant in the canoe which can quickly tip or capsize the canoe. Most prior art pontoon assemblies are somewhat cumbersome. Many are attachable but at the same time are large and very unwieldy and are difficult to add or remove from the water.

It is desirable not to have the pontoons extended when one is paddling a kayak or a canoe and then to rapidly extend the floatation device as needed to stabilize the canoe when the canoe is not in motion and when the occupant desires to stand, such as while fishing or to move around in the kayak. It is an object of the present invention that a floatation assembly can be rapidly and removably attached and removed to and from a kayak or canoe and which can be extended to use as a flotation device either on one or both sides of the kayak. The floatation on both sides can be raised for paddling a kayak with greater ease.

In the past, there have been a large number of outboard floatation devices especially for adding to a canoe and these include the Birkett U.S. Pat. No. 4,641,594 for a canoe conversion kit for use alone as an iceboat or for easy mounting on a canoe to convert the canoe to a sailboat. In the Nielsen U.S. Pat. No. 5,174,233, a self-adjusting boat outrigger is provided. The Morriseau U.S. Pat. No. 6,860,216 is a canoe pontoon assembly which has side runners which are attached adjacent to the canoe to prevent the canoe from tipping over. Pontoons are adjustable for height and width and deploys a ballast to stabilize a canoe. The Hall U.S. Pat. No. 6,000,355 is a stabilized watercraft having an elongated V-type hull and stabilizers mounted in outrigger fashion. Each stabilizer has an elongated floatation member that can be extended and retracted with a pantographic-type extension mechanism. The Grzybowski U.S. Pat. No. 6,305,306 is a watercraft stabilization system for a canoe which has a pair of floatation devices. The Barker, Jr. U.S. Pat. No. 5,988,090 is a stabilization pontoon system for a small watercraft which has a pair of adjustable outriggers connected by a linkage system to an actuator so that each pontoon can be lowered into the water to stabilize the watercraft.

The present invention, on the other hand, is directed primarily to watercraft, such as a kayak or canoe, and to an outrigger floatation system which is in a raised or storage position while paddling the kayak or canoe and which can be rapidly extended to add stabilization to the watercraft so that the occupant can stand for fishing or doing other functions without the watercraft tipping over and capsizing. A pontoon can be extended from one or both sides, as desired.

SUMMARY OF THE INVENTION

The present invention relates generally to a stabilization system for watercraft, such as kayaks and canoes, and to a pontoon assembly for stabilizing a watercraft. A base member is removably attachable to a watercraft for holding the pontoon assembly. An elongated pontoon support arm has two end portions and has a pontoon attached to one end portion. A supporting bracket for the pontoon supporting arm is movably attached to the base member and slidably supports the pontoon supporting arm therein between the two end portions thereof so that the pontoon supporting arm can tilt on and slide in the arm supporting bracket. A linkage is movably attached to the base and to the other end of the pontoon supporting arm and has a pair of link members movably attached to each other. The linkage is adapted to raise the other end of the pontoon supporting arm to lower and extend the pontoon into an operative position. The pontoon supporting arm tilts on and slides in a pontoon supporting arm supporting bracket to lower one end of the pontoon supporting arm when the linkage is raised and to raise and withdraw the pontoon into a rest position when the linkage is lowered. A locking mechanism is used to lock the linkage in a raised position with the pontoon in an operative position. Pontoons can be mounted on both sides of the base member to allow individual pontoons to be extended from one or both sides of a canoe or kayak. Each elongated pontoon supporting arm has a handle mounted to the other end portion thereof. The pontoon supporting arm and the pontoon can be held in an operative position with a locking mechanism which may be an eccentrically mounted block rotatably attached to the pontoon supporting arm for rotation to different block positions between the pontoon supporting arm and the linkage. The linkage has two links movably attached to each other to allow the linkage to fold when lowering the pontoon supporting arms into a rest position. When the linkage is extended and unfolded, one link moves a portion thereof over the second link to thereby stop or lock the two links together in an extended position with the pontoon supporting arm at the other end in a raised position and the pontoon in a lowered and extended position. A handle on one of the linkage link members allows one of the hinged links to be lifted for folding the linkage to the lower pontoon support arm other end to raise and withdraw the pontoon to a rest position. The pontoon assembly would normally have one base member with two pontoon assemblies attached thereto. The supporting arm bracket has a passageway therethrough for the pontoon supporting arm to slide therein and the passageway has a self-lubricating polymer surface or the entire supporting bracket which may be made of a self-lubricating polymer. The pontoon assembly is attached to a kayak with a strap wrapping around the kayak, which strap is attached to a reel shaft rotatably attached to the base. The reel shaft has a ratchet and pawl mechanism operatively attached thereto for tightening and locking the strap around the watercraft to hold the base and pontoon assembly to the watercraft.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
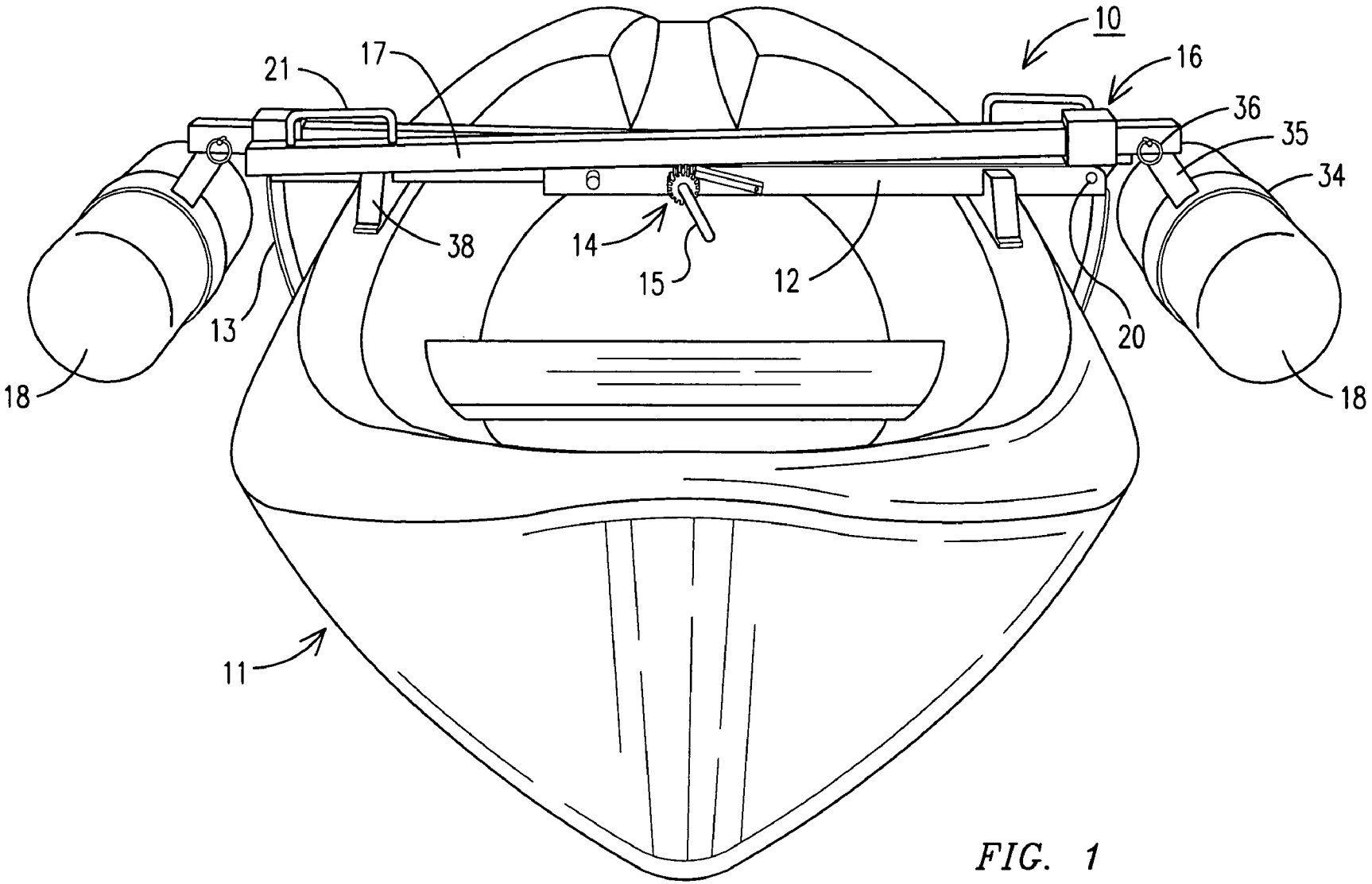
FIG. 1 is a perspective view of a kayak having the watercraft stabilization system attached thereto with the pontoons in a raised and rest position.
Figure 2:
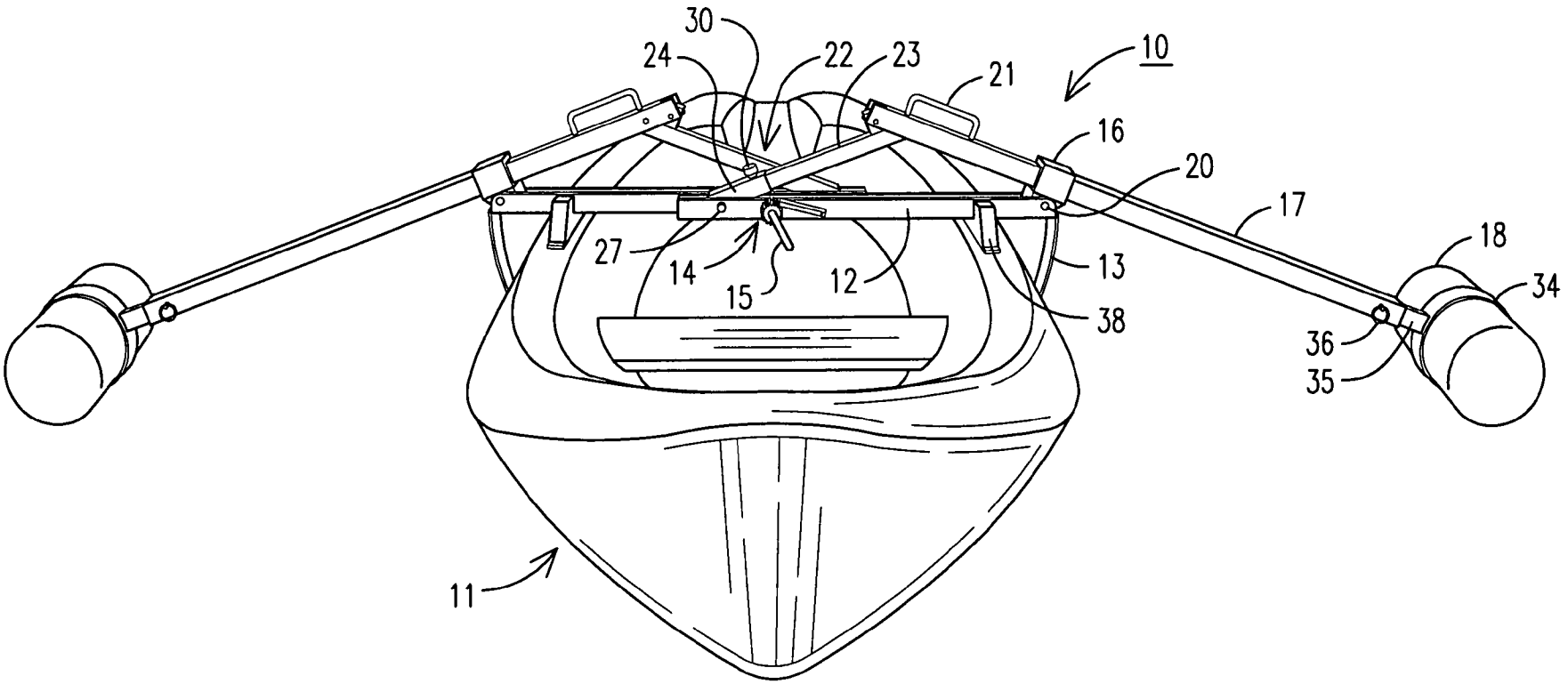
FIG. 2 is a perspective view of the kayak of FIG. 1 having the pontoons in an extended and operative position.
Figure 3:
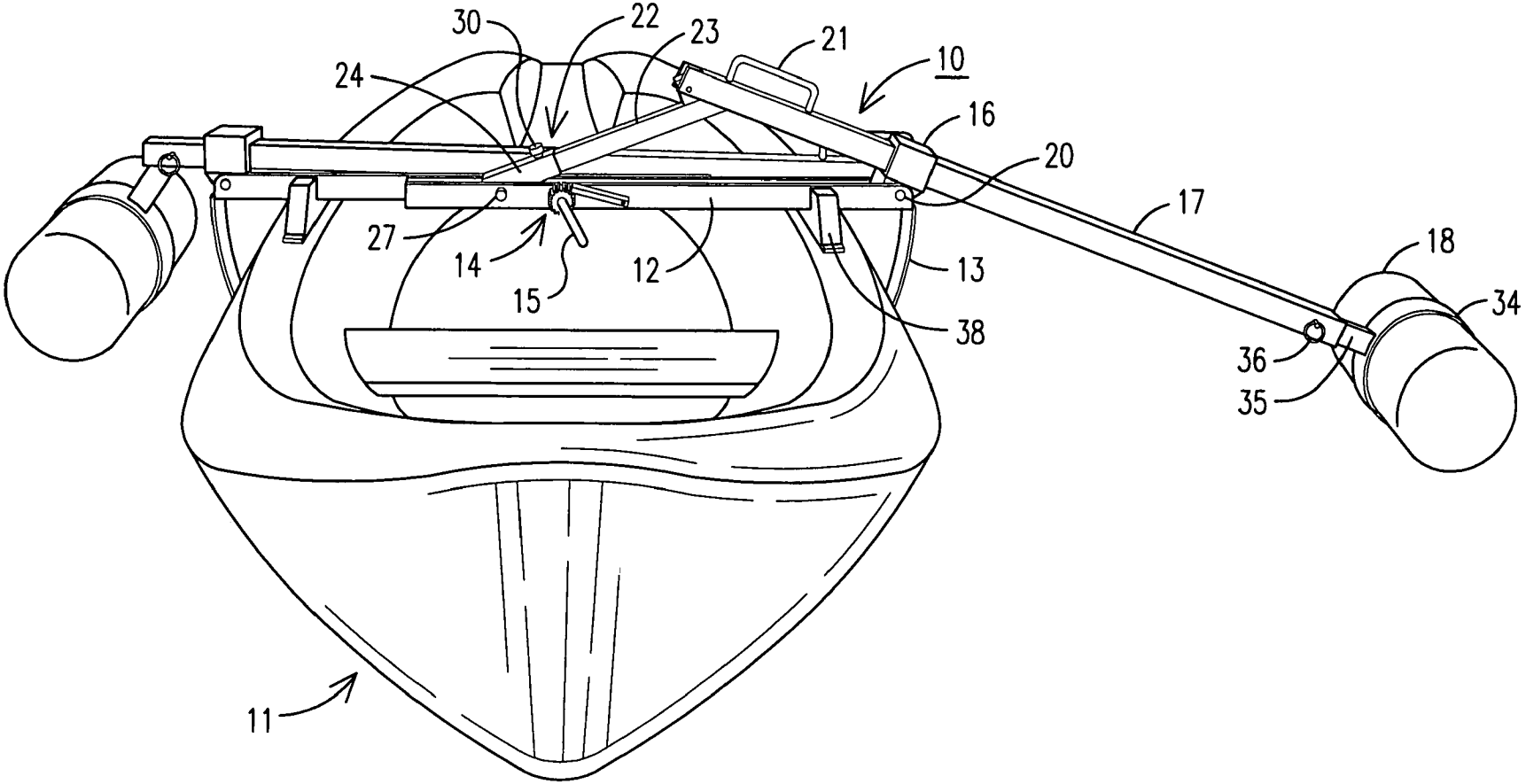
FIG. 3 is a perspective view of the kayak of FIGS. 1 and 2 having one pontoon extended in an operative position and a second one in a raised rest position.

Referring to the drawings, a watercraft stabilization system 10 is illustrated, as shown in FIGS. 1-6, mounted to a kayak 11. The system 10 can also be mounted to a canoe, as desired, or any other watercraft. The watercraft stabilization system 10 has base member 12 which is mounted to the watercraft 11, as shown in FIGS. 1-3. The base 12 is removably attached to the kayak in FIGS. 1 through 3 using a strap 13 which wraps around the kayak and base member 12 and is tightened and locked around the kayak with a ratchet and pawl mechanism 14 having a handle 15 which rotates the shaft having a strap 13 attached thereto for tightening onto the kayak. The base 12 has a pair of pontoon supporting arms supporting brackets 16 each movably attached to one end of the base 12 and each having a passageway therethrough. A pontoon supporting arm 17 supports a pontoon 18 on one end thereof and is slidably mounted in the supporting bracket 16. The supporting bracket 16 has a passageway therethrough and is movably mounted on a pin 20 to the base 12 so that the support arm 17 can tilt on and slide in the bracket 16. Each support arm 17 has a handle 21 on one end for lifting and moving the position of the pontoon support arm 17 and pontoon 18.

A linkage 22 has a pair of links 23 and 24 movably attached together with a pin 25. The link 23 is attached to one end portion of the pontoon supporting arm 17 using a pin 26 while the link 24 is pinned to the base 12 with a pin 27. This arrangement allows the linkage 22 to be folded into a rest position thereby sliding and raising the pontoon 18 into the rest position, as shown in FIG. 1. The linkage 22 can be unfolded to a raised position, as shown in FIG. 2, to tilt and slide the pontoon support arm 17 into an extended or operative position positioning the pontoon 18 in a position to stabilize the watercraft 11. The linkage 22 is locked in the raised or operative position by the link 24 end portion extending well beyond the pin 25 so that in the extended position, the link 24 extending portion 28 acts as a stop or lock when it folds against the top of the link 23. To release the lock from the extended position, a small handle 30 is provided which allows the link 24 to be lifted sufficiently that a pontoon support arm 17 can be slid and tilted with a handle 21 to thereby fold the linkage 22 into a folded or rest position.

Figure 5:
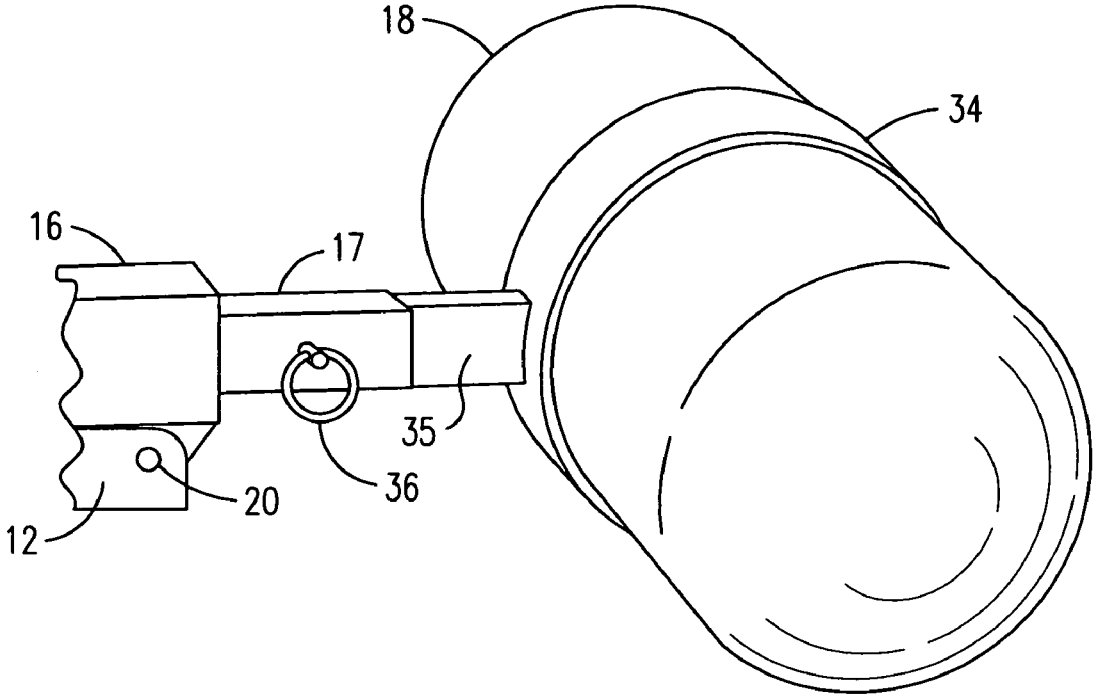
FIG. 5 is a perspective view of the pontoon connected in one position to the pontoon supporting arm.
Figure 6:
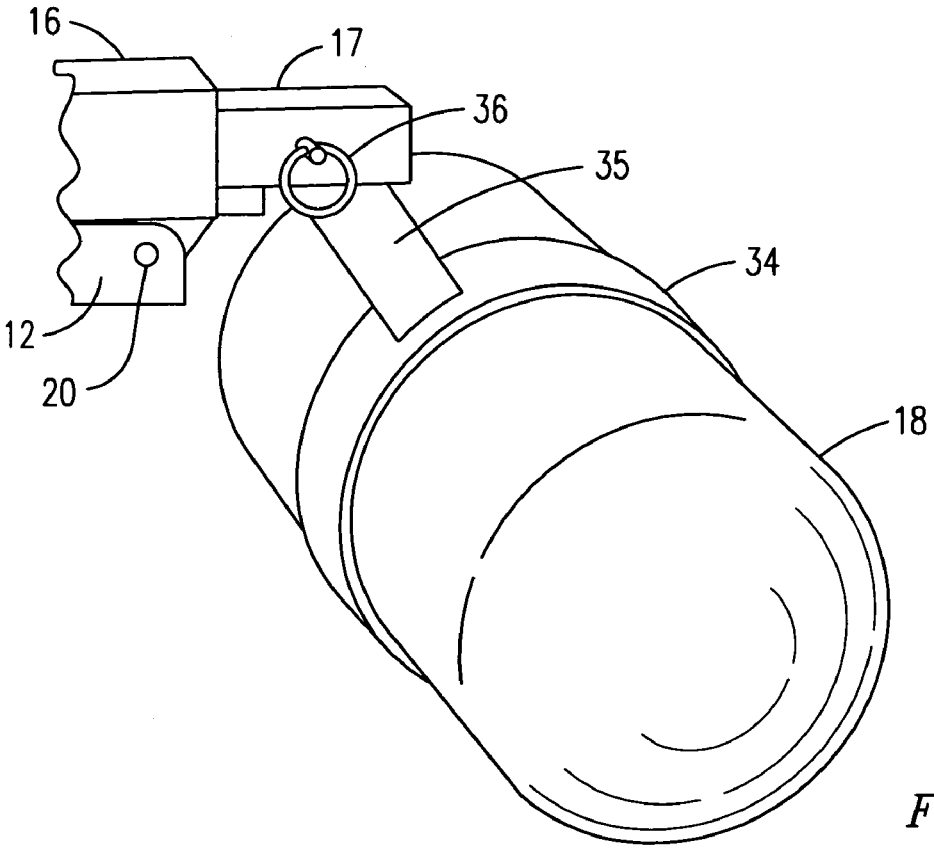
FIG. 6 is a perspective view of the pontoon of the present invention connected in a second position to the pontoon supporting arm.

The pontoon 18 can be positioned in different positions by a locking block 31 pinned with a pin 32 to one end of the pontoon supporting arm 17. The pin 32 is pinned to the block 31 in an off center position that allows the block 31 to eccentrically to position different faces against the surface of the link 23. The block 31 can have numbers 33 or other indicia to indicate different positions for supporting the pontoon support arm 17 relative to the link 23 thereby positioning the pontoon in a different raised or lowered position. In addition, each pontoon 18 is attached to the pontoon supporting arm 17 with a strap 34 which is attached to a support arm 35. Arm 35 is movably pinned with pin 36 to allow the pontoon 18 to extend, as shown in FIG. 5, when the pontoon is in the water. The pontoon, as shown in FIG. 6, is allowed to drop when in a raised position. This keeps the pontoon 18 closer to the kayak when the pontoon is not in use.

In operation, a pair of pontoon assemblies are attached to a watercraft 11, such as a kayak or canoe, as shown in FIGS. 1, 2 and 3. Each assembly is attached to the base member 12, which base member is two members attached together as a unit and attached to the watercraft 11. Each pontoon assembly operates separately and can extend a pontoon 18 to either side of the watercraft 11. The pontoon 18 extends from the rest position in FIG. 1 with each pontoon withdrawn from the water and supported on the sides of the watercraft 11. Each pontoon 18 can then be extended by grabbing either of the handles 21 on the pontoon support arm 17 and raising it to shift one pontoon at a time into an operative position, as shown in FIGS. 2 and 3. When raising the handle 21 to raise the pontoon supporting arm 17, the supporting arm raises the linkage 22 to rotate the link members 23 and 24 until the locking portion 28 of link 24 stops onto link member 23. Link member 23 comes to a rest on the locking block 31 which has been rotated and positioned to position the pontoon supporting arm 17 and the pontoon 18 in the desired position in the water beside the watercraft 11. This results by the pontoon supporting arm 17 tilting with the arm supporting bracket 16 tilting on the pin 20 on the base member 12 and simultaneously sliding in the arm supporting bracket to both extend and lower the pontoon beside the canoe or kayak. When the arm 17 is raised, the pontoon 18 drops by arm 35 rotating on pin 36, as shown in FIG. 6. When the arm 17 lowers the pontoon 18 in the water, the pontoon is forced into the position shown in FIG. 5 where it is held in position by the end of the arm 35 pressing against arm 17.

Figure 4:
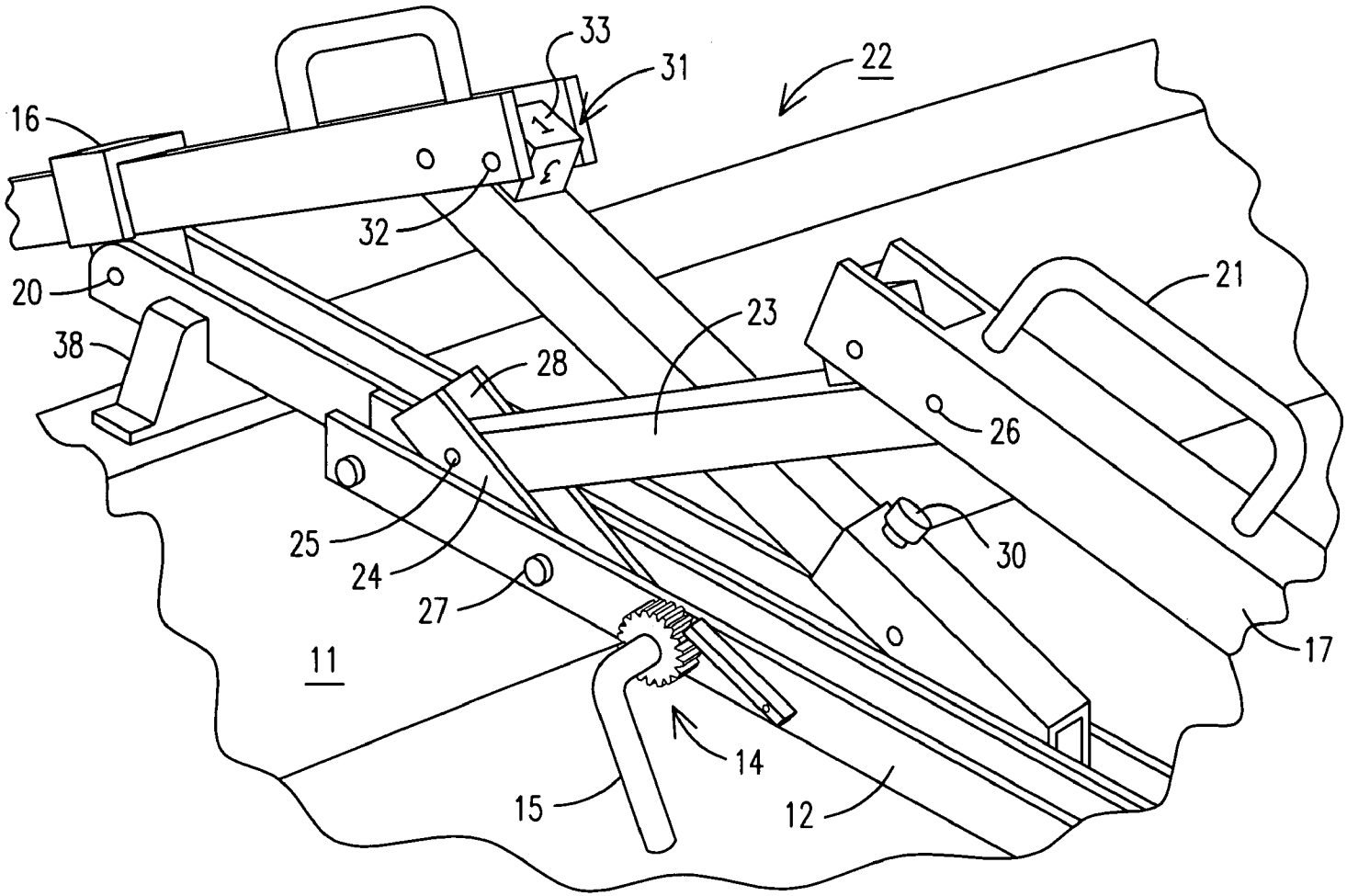
FIG. 4 is a perspective view of a portion of the pontoon assembly.

The operation is more clearly illustrated in FIG. 4. When it is desired to raise the pontoons 18, the handle 21 on either pontoon supporting arm 17 is grasped and lifted while the handle 30 can also be slightly lifted to ease the lifting of the handle 21. Lifting the handle 21 pulls and tilts pontoon supporting arm 17 in the bracket 16 while folding the linkage 23 and 24 on the pin 25 to bring it to a rest position, as shown in FIG. 1.

A watercraft stabilization system has been illustrated which can be easily attached to a watercraft, such as a canoe or a kayak. It should also be clear that while a stabilization system has been illustrated attached to a kayak, it can as easily be attached to a canoe or other watercraft. In attaching to a kayak, the strap 13 is wrapped around the kayak to hold the base member 12 and braces 38 resting on the side of the kayak. The strap is attached to one end of one base member 12 and rides in the second base member 12 and is attached to a reel or shaft which is rotated by a handle 15 and locked in place with a ratchet and paw mechanism 14.

It should be clear at this point that a watercraft stabilization system has been provided which advantageously is rapidly deployed for stabilizing the watercraft and is rapidly lifted and tilted to a rest position for paddling or moving the watercraft. However, the present invention should not be considered limited to the forms shown which are to be considered illustrative rather than restrictive.

We claim:

1. A pontoon assembly for stabilizing a watercraft comprising:

a base member removably attachable to a watercraft;

an elongated pontoon supporting arm having two end portions and having a pontoon attached to one end portion thereof;

a pontoon supporting arm supporting bracket moveably attached to said base member and slidably supporting said pontoon supporting arm therein between the two end portions thereof;

a linkage movably attached to said base and to other end portion of said two end portions of said pontoon supporting arm, said linkage adapted to raise the other end portion of said pontoon supporting arm to lower and extend said pontoon into an operative position by tilting and sliding said pontoon supporting arm in said pontoon supporting arm supporting bracket and to lower said one end portion of said pontoon supporting arm to raise and withdraw said pontoon into a rest position by tilting and sliding said supporting arm in said pontoon supporting arm supporting bracket;

a locking mechanism for locking said linkage in a raised position with said pontoon in an operative position; and a flexible strap for extending around a watercraft, said strap being attached to a reel shaft rotatably attached to said base and said reel shaft having a ratchet and pawl mechanism operatively attached thereto for tightening and locking said strap around a watercraft to hold said base to said watercraft;

whereby a pontoon may be rapidly raised or lowered into the water adjacent a watercraft.

2. The pontoon assembly for stabilizing a watercraft in accordance with claim 1 in which said elongated pontoon supporting arm has a handle mounted to the other end portion thereof.

3. The pontoon assembly for stabilizing a watercraft in accordance with claim 2 in which said locking mechanism has an off-center mounted block rotatably attached to said pontoon supporting arm for rotation to different block positions between said pontoon supporting arm and said linkage.

4. The pontoon assembly for stabilizing a watercraft in accordance with claim 1 in which said linkage has two links movably attached to each other to allow said linkage to fold when lowering said pontoon supporting arm into a rest position.

5. The pontoon assembly for stabilizing a watercraft in accordance with claim 4 in which one link of said linkage has a stop thereon to lock said two links together in an extended position with said other end portion in a raised position and said pontoon is in a lowered and extended position.

6. The pontoon assembly for stabilizing a watercraft in accordance with claim 5 in which said linkage one link has a handle thereon for lifting said one link to allow folding of said linkage to lower said other end portion and raise and withdraw said pontoon.

7. The pontoon assembly for stabilizing a watercraft in accordance with claim 1 in which said base member has two elongated pontoon supporting arms each having a pontoon attached thereto for extending a pontoon to each side of a watercraft.

8. The pontoon assembly for stabilizing a watercraft in accordance with claim 1 in which said arm supporting bracket has a passageway therethrough having a self lubricating polymer surface for said elongated pontoon support arm to slide therein.

9. A pontoon assembly for stabilizing a watercraft comprising:

a base member removably attachable to a watercraft;

a pair of elongated pontoon supporting arms, each having two end portions and each having a pontoon attached to one end portion thereof;

a pair of pontoon supporting arm supporting brackets each moveably attached to said base member and each slidably supporting one of said pontoon supporting arms therein between the two end portions thereof;

a pair of linkages each movably attached to said base and to other end portion of said two end portions of one of said pontoon supporting arms, each said linkage being adapted to raise the other end portion of one of said pontoon supporting arms to tilt and slide each said pontoon into an operative position on opposite sides of said watercraft and to lower said one end portion of each said pontoon supporting arm to tilt and slide each said pontoon into a rest position;

a pair of locking mechanisms for locking each of said pair of linkages in a raised position with each said pontoon in an operative position; and a flexible strap for extending around a watercraft, said strap being attached to a reel shaft rotatably attached to said base and said reel shaft having a ratchet and pawl mechanism operatively attached thereto for tightening and locking said strap around a watercraft to hold said base to said watercraft;

whereby a pair of pontoons may be rapidly raised or lowered into the water adjacent a watercraft.

10. The pontoon assembly for stabilizing a watercraft in accordance with claim 9 in which each said elongated pontoon supporting arm has a handle mounted to the other end portion thereof.

11. The pontoon assembly for stabilizing a watercraft in accordance with claim 10 in which each said locking mechanism has an off-center mounted block rotatably attached to each said pontoon supporting arm for rotation to different block positions between each said pontoon supporting arm and each said linkage.

12. The pontoon assembly for stabilizing a watercraft in accordance with claim 9 in which each said linkage has two links movably attached to each other to allow each said linkage to fold when lowering each said pontoon supporting arm into a rest position.

13. The pontoon assembly for stabilizing a watercraft in accordance with claim 12 in which one link of each said linkage has a stop thereon to lock each said two links together in an extended position with each said other end portion in a raised position and each said pontoon is in a lowered and extended position.

14. The pontoon assembly for stabilizing a watercraft in accordance with claim 13 in which each said linkage one link has a handle thereon for lifting said one link to allow folding of one said linkage to lower one said other end portion and raise and withdraw one said pontoon.

15. The pontoon assembly for stabilizing a watercraft in accordance with claim 9 in which each said arm supporting bracket has a passageway therethrough having a self lubricating polymer surface for one said elongated pontoon support arm to slide therein.

* * * * *